US010662715B2

(12) United States Patent
Bruandet

(10) Patent No.: US 10,662,715 B2
(45) Date of Patent: May 26, 2020

(54) DOWN-THE-HOLE HAMMER DRILL BIT RETAINING ASSEMBLY

(71) Applicant: SANDVIK INTELLECTUAL PROPERTY AB, Sandviken (SE)

(72) Inventor: Olivier Bruandet, Tampere (FI)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 16/081,592

(22) PCT Filed: Mar. 1, 2017

(86) PCT No.: PCT/EP2017/054707
§ 371 (c)(1),
(2) Date: Aug. 31, 2018

(87) PCT Pub. No.: WO2017/148978
PCT Pub. Date: Sep. 8, 2017

(65) Prior Publication Data

US 2019/0345772 A1 Nov. 14, 2019

(30) Foreign Application Priority Data

Mar. 4, 2016 (EP) ..... 16158627

(51) Int. Cl.

| | |
|---|---|
| ***E21B 10/36*** | (2006.01) |
| ***E21B 34/06*** | (2006.01) |
| *E21B 4/14* | (2006.01) |
| *E21B 6/02* | (2006.01) |
| *E21B 17/07* | (2006.01) |
| *E21B 44/00* | (2006.01) |

(52) U.S. Cl.
CPC ..... *E21B 10/36* (2013.01); *E21B 34/06* (2013.01); *E21B 4/145* (2013.01); *E21B 6/02* (2013.01); *E21B 17/076* (2013.01); *E21B 44/005* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,968,503 A * | 1/1961 | Ferrara | ..... | F16B 21/186 403/375 |
| 4,200,158 A * | 4/1980 | Perkins | ..... | E21B 31/113 166/178 |
| 4,862,976 A | 9/1989 | Meek | | |

(Continued)

FOREIGN PATENT DOCUMENTS

| | | |
|---|---|---|
| CA | 2615618 A1 | 1/2001 |
| CN | 101223333 A | 7/2008 |

(Continued)

*Primary Examiner* — Taras P Bemko
*Assistant Examiner* — Ronald R Runyan
(74) *Attorney, Agent, or Firm* — Corinne R. Gorski

(57) ABSTRACT

A down-the-hole hammer drill bit retaining assembly is arranged to releasably retain a drill bit at a hammer arrangement of a percussion drilling apparatus. The retaining assembly includes a drive sub and a retainer ring. The drive sub has at least one indent to provide a fluid communication pathway for a flushing fluid extending over a radially outward facing surface of the retainer ring and into an internal region of the drive sub in contact with inwardly projecting splines.

14 Claims, 14 Drawing Sheets

(56) References Cited

U.S. PATENT DOCUMENTS

| | | | | |
|---|---|---|---|---|
| 5,803,192 | A | 9/1998 | Holte | |
| 6,131,672 | A | 10/2000 | Beccu et al. | |
| 8,640,794 | B2 * | 2/2014 | Aros | E21B 10/38 175/296 |
| 2007/0089908 | A1 | 4/2007 | Underwood | |
| 2012/0103692 | A1 | 5/2012 | White et al. | |

FOREIGN PATENT DOCUMENTS

| | | | |
|---|---|---|---|
| CN | 101356339 | A | 1/2009 |
| CN | 101529043 | A | 9/2009 |
| CN | 103228859 | A | 7/2013 |
| EP | 0005384 | A1 | 11/1979 |
| EP | 1462604 | A2 | 9/2004 |
| GB | 1424494 | A | 2/1976 |
| RU | 2522325 | C1 | 7/2014 |
| WO | 9854433 | A1 | 12/1998 |
| WO | 200121930 | A1 | 3/2001 |
| WO | 2008051132 | A1 | 5/2008 |
| WO | 2013104470 | A2 | 7/2013 |

* cited by examiner

DOWN-THE-HOLE HAMMER DRILL BIT RETAINING ASSEMBLY

RELATED APPLICATION DATA

This application is a § 371 National Stage Application of PCT International Application No. PCT/EP2017/054707 filed Mar. 1, 2017 claiming priority to EP 16158627.6 filed Mar. 4, 2016.

FIELD OF INVENTION

The present invention relates to a down-the-hole hammer drill bit retaining assembly to releasably retain a drill bit at a hammer arrangement and in particular, although not exclusively, to a retaining assembly that provides strong and reliable retention of the drill bit.

BACKGROUND ART

The technique of down-the-hole (DTH) percussive hammer drilling involves the supply of a pressurised fluid via a drill string to a drill bit located at the bottom of a bore hole. The fluid acts to both drive the hammer drilling action and to flush rearwardly dust and fines resultant from the cutting action, rearwardly through the bore hole so as to optimise forward cutting.

Typically, the drill assembly comprises a casing extending between a top sub and a drill bit that, in turn, is releasably coupled to a drive component (commonly referred to as a chuck or drive sub). Drilling is achieved via a combination of rotation and axial translation of the drill bit. Rotation is imparted to the drill bit from the drive sub via intermediate engaging splines. The axial percussive action of the bit is achieved via a piston that is capable of shuttling axially between the top sub and the drill bit and is driven by the pressurised fluid to strike a rearward anvil end of the bit. In some embodiments, a foot valve extends axially rearward from the drill bit to mate with the piston during its forward-most stroke to control both the return stroke and provide exhaust of the pressurised fluid from the drill head that acts to flush rearwardly the material cut from the bore face. Example DTH hammer drills are described in WO 2008/051132, WO 2013/104470 and U.S. Pat. No. 6,131,672.

Conventionally, the drill bit is retained at the assembly and in contact with the drive sub via a retainer ring. The retainer ring extends around a rearward end of the drill bit shaft and is configured to abut a radially projecting shoulder positioned at the axial rearward end of the bit shaft. Such a configuration prevents the drill bit from falling out of the hammer assembly during flushing or when the hammer assembly (and the drill bit) are loaded into or extracted from the borehole. Example retainer ring assemblies are described in U.S. Pat. No. 5,803,192; US 2007/0089908; EP 1462604 and WO 2001/21930.

However, these conventional retaining assemblies are disadvantageous for a number of reasons. In particular, in an attempt to minimise wear at the drive sub splines, a portion of the pressurised fluid delivered to the drill bit is diverted to the radially outer region of the bit and into contact with drive sub splines. Typically this diverted fluid flow passes between the radially inner surface of the retainer ring and the outer surface of the drill bit shaft. Accordingly, conventional retainer rings include flow path channels or otherwise have a structure to allow the lubricating fluid to reach the axially forward drive sub splines. However, these airflow passageways at the radially inner region of the retainer ring reduce the area contact of the ring with the abutment shoulder of the drill bit. Accordingly, conventional bit retainers are weakened and drill bit retention is compromised. Accordingly, what is required is a drill bit retaining assembly that addresses the above problems and in particular allows delivery of a desired volume of lubricating fluid to the splines whilst providing a secure and reliable retention of the drill bit.

SUMMARY OF THE INVENTION

It is an objective of the present invention to provide percussive drill apparatus and in particular a drill bit retaining assembly that is configured to maintain strong and reliable retention of the drill bit when required whilst enabling delivery of a desired volume of a lubricant containing fluid to the radially outer region of the drill bit and in contact with the rotational drive splines projecting radially inward from the drive sub.

It is a further specific objective to provide a retaining assembly compatible with existing drill bits and a piston hammer arrangement specifically with regard to the radial and axial dimensions of such arrangements and components and hence does not require changes to existing percussive drilling apparatus.

The objectives are achieved by providing a down-the-hole hammer drill bit retaining assembly comprising drive sub and retainer ring configured specifically to allow a fluid flow pathway over a radially external facing surface of the retainer ring and then into contact with a radially inward facing surface of the drive sub and importantly the drive sub splines. Accordingly, the radially inner region of the retainer ring is configured and optimised for abutment contact with the axially rearward shoulder projecting from the bit shaft and in particular to maximise the surface area contact with the shoulder when the retainer ring is required to retain the drill bit at the hammer assembly between drilling/hammering intervals. Accordingly, the present retainer ring and drill bit retaining assembly provides a dual function of retaining the drill bit securely and reliably in addition to defining a desired fluid flow pathway into the region of the drive sub splines with this passageway extending exclusively or predominantly over the radially outer surface or region of the retainer ring.

According to a first aspect of the present invention there is provided a down-the-hole hammer drill bit retaining assembly to releasably retain a drill bit at a hammer arrangement, the retaining assembly comprising: an annular drive sub having a rearward end and a radially inward facing surface provided with radially inward projecting splines to mate with radially outward projecting splines of a drill bit; a retainer ring mountable in contact with the rearward end of the drive sub having a radially inward and outward facing surface and an axially rearward facing abutment face to overlap radially with and abut a shoulder projecting radially outward from the drill bit; characterised by: at least one passageway defined by at least a part of the drive sub and/or the retainer ring, the passageway having a rearward end in fluid communication with the outward facing surface of the retainer ring and a forward end in fluid communication with the inward facing surface of the drive sub to provide a fluid communication pathway for the delivery of a fluid over the outward facing surface of the retainer ring and to the splines of the drive sub.

The forward and rearward ends of the passageway may be defined relative to a fluid flow direction that extends axially forward from the hammer piston to the drill bit head. The fluid flow pathway also encompasses radial flow or passage of the fluid through or past the body of the retainer ring in a generally radial direction (transverse or perpendicular to a longitudinal axis of the hammer arrangement and retainer assembly).

Preferably, the passageway is a slot extending through a radial thickness of the drive sub between an outward and the inward facing surface at or towards the rearward end of the drive sub. Optionally, the slot may extend from an axial end face of the drive sub. The at least one slot may be formed as a notch or recess in the otherwise annular end face of the drive sub. Optionally, the passageway is at least one hole or bore extending through the wall of the tubular drive sub. Preferably, the drive sub comprises a plurality of slots (or holes) extending axially and radially into/though the body of the drive sub at or towards the axial end. Each individual slot (hole, recess or notch) that defines a fluid flow opening through the wall of the drive sub, extends a short axial distance along the drive sub corresponding to less than 20, 15, 10 or 5% of the total axial length of the drive sub. Optionally, the drive sub comprises between two to ten slots or bore hole at or towards the rearward end.

Optionally, the at least one passageway is defined by a part of the retainer ring. In particular, the retainer ring may comprise an indent, slot, notch or borehole extending through the wall of the retainer ring to provide a pathway for fluid flow from the radially outer region or surface of the retainer ring to the inner region of the drive sub and in particular the drive sub splines. Optionally, the passageway is defined by respective regions of the drive sub and retainer ring. Optionally, the passageway may be defined exclusively by the retainer ring that comprises a plurality of indents, recessed regions, bores or notches for example extending axially into the retainer ring from an axially forward facing end surface or edge. Accordingly, fluid is capable of flowing radially past or through the retainer ring via such indents, recesses, notches or bores.

Preferably, the retainer ring and the drive sub are configured such that the drive sub is positionable to axially overlap and to radially encompass at least a part of the retainer ring. Accordingly, the retainer ring comprises an external diameter being less than (but approximately equal to) an internal diameter of the drive sub at its rearward end. Accordingly, the drive sub is configured to encapsulate in close fitting contact at least an axially forward region of the retainer ring. Such a configuration maintains the segments of the retainer ring as an annular assembly in mounted position over the drill bit shaft. This is advantageous to obviate the need for any additional retaining gasket.

Optionally, the retainer ring comprises at least one break in its annular length to provide a split-ring configuration. Optionally the ring is formed by two half segments connected end-to-end to form an annulus. Such an arrangement enables the ring to be located in position over and about the drill bit shaft between the radially enlarged axially rearward bit shoulder and axially forward bit head. Optionally the split ring may comprise metal. Optionally the ring may be a single-piece construction and formed from an elastic material so as to be capable of being elastically deformed when being located in position at the bit shaft. Optionally the ring comprises a polymeric material.

Preferably, in a circumferential direction around an annular length of the retainer ring, the retainer ring comprises a uniform internal diameter. Accordingly, the internal region of the retainer ring is optimised for maximising the surface area contact with the drill bit shoulder. That is, the present retainer ring does not comprise channels, grooves or projections extending radially at the ring inward facing surface. The retainer ring inward facing surface is accordingly circular.

Optionally, the drive sub may comprise an annular shoulder provided at or towards the rearward end to mate with the retainer ring. Optionally, the retainer ring may comprise an annular shoulder to mate with the annular shoulder of the drive sub. Such a configuration is advantageous to enhance the axial and radial connection of the drive sub and the retainer ring as a unified assembly within the hammer arrangement.

Preferably, the passageway extends axially along the drive sub beyond a region of the axial overlap of the drive sub and the retainer ring. Optionally, an axial length of the passageway is greater than an axial length of the retainer ring such that at least part of the opening defined by the at least one passageway at the drive sub is unobstructed by the retainer ring to create the 'clear' apertures through the retaining assembly to establish and maintain the fluid flow pathway. Optionally, the drive sub is mountable in fluid tight sealing contact with the retainer ring such that the passageway provides exclusively the fluid communication pathway from the outward facing surface of the retainer ring to the splines.

Optionally, the retainer ring comprises at least one passageway or indent at the outward facing surface to further define the fluid communication pathway at a region of the retainer ring. Optionally, the at least one passageway or indent of the retainer ring is a slot extending through a radial thickness of the retainer ring between the inward and outward facing surfaces and/or is a groove extending axially along at least part of the retainer ring to define a part of the fluid communication pathway to the outward facing surface of the retainer ring. Optionally, the retainer ring comprises at least one slot and at least one groove with the groove and slot aligned in a circumferential direction. Preferably, the retainer ring comprises a plurality of grooves and slots arranged in pairs and being aligned in the circumferential direction such that fluid is capable of flowing through a slot and along a respective groove at the radially outward facing surface of the ring. Optionally, the retainer ring comprises a first set of slots at an axially forward facing end face or edge and a second set of slots at an axially rearward facing end face or edge.

Preferably, the assembly further comprises a locating collar having an inward facing surface mountable over an axially rearward part of the drill bit and having an axially forward end in contact with at least a part of the retainer ring. The collar is configured to retain positionally the retainer ring within the assembly to be suspended over and about the drill bit shaft axially forward of the drill bit shoulder.

Optionally, the locating collar comprises at least one indent or passageway extending axially from the forward end to further define a part of the fluid communication pathway to the outward facing surface of the retainer ring. Optionally, the at least one indent or passageway within the collar may be a slot extending radial through a thickness of the collar between a radially outward and inward facing surface and/or the at least one indent or passageway may be an axially extending groove formed in the outward facing surface of the collar. Preferably, the collar comprises a plurality of slots and/or grooves.

According to a second aspect of the present invention there is provided drilling apparatus for percussive rock drilling comprising: a hammer arrangement mountable at one end of a drill string, the hammer arrangement comprising an axially movable piston; a drill bit mounted at least partially within the hammer arrangement; and a retaining assembly as claimed in any preceding claim to releasably retain the drill bit at the hammer arrangement.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
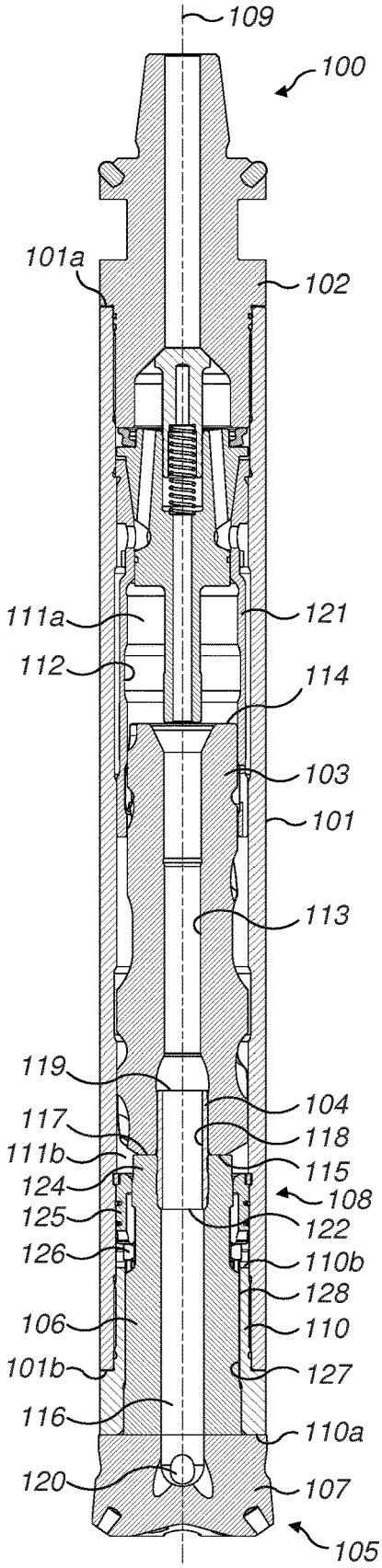
FIG. 1 is an axial cross sectional view of a down-the-hole hammer drill assembly according to a specific implementation of the present invention.

Referring to FIG. 1, a down-the-hole (DTH) hammer drill assembly 100 comprises a substantially hollow cylindrical casing 101. A top sub 102 is at least partially accommodated within a rearward end of casing 101 whilst a drill bit 105 is at least partially accommodated within a forward end. Drill bit 105 comprises an elongate shaft 106 having internal passageway 116. A drill bit head 107 is provided at a forward end of shaft 106 and comprises a plurality of wear resistant cutting buttons (not shown). An axially rearward face 117 of shaft 106 represents an anvil end of drill bit 105.

A distributor cylinder 121 extends axially within casing 101 and has an inward facing surface 112 that defines an axially extending internal chamber 111*a*, 111*b*. Casing 101 comprises an axially forward end 101*b* and an axially rearward end 101*a*. An elongate piston 103 extends axially within casing 101 and is capable of shuttling back and forth along central longitudinal axis 109 extending through the assembly 100. Piston 103 comprises an axially rearward end 114 and an axially forward end 115. An internal bore 113 extends axially between ends 114, 115.

A foot valve 104 projects axially rearward from the anvil end of drill bit shaft 106 and comprises a generally cylindrical configuration having a rearward end 119 and a forward end 122. An internal passageway 118 extends axially between ends 119, 122 in fluid communication with drill bit passageway 116 and piston bore 113. In particular, an axially forward region of foot valve 104 is embedded and locked axially within the rearward anvil end region of drill bit shaft 106. In particular, just over half of the axial length of foot valve 104 extends rearward from anvil end 117.

Distributor cylinder 121, in part, defines the internal chamber having an axially rearward region 111*a* and axially forward region 111*b*. Piston 103 is capable of reciprocating axially to shuttle within chamber regions 111*a*, 111*b*. In particular, a pressurised fluid is delivered to drill assembly 100 via a drill string (not shown) coupled to top sub 102. Distributor cylinder 121 and casing 101 control the supply of the fluid to the chamber regions 111*a*, 111*b*. As will be appreciated, with fluid supplied to the axially rearward region 111*a*, piston 103 is forced axially towards drill bit 105 such that the piston forward end 115 strikes bit anvil end 117 to provide the percussive drilling action to the cutting buttons. Fluid is then supplied to the forward chamber region 111*b* to force piston 103 axially rearward towards top sub 102. With piston 103 in the axially forwardmost position, foot valve 104 is mated within piston bore 113 to isolate and close fluid communication between drill bit passageway 116 and chamber region 111*b*. As piston 103 is displaced axially rearward, piston end 115 clears foot valve end 119 to allow the pressurised fluid to flow within drill bit passageway 116 and to exit drill bit head 107 via flushing channels 120. Accordingly, the distributed supply of fluid to chamber regions 111*a*, 111*b* creates the rapid and reciprocating shuttling action of piston 103 that, in turn, due to the repeated mating contact with foot valve 104, provides a pulsing exhaust of pressurised fluid at the drill bit head 107 as part of the percussive drilling action.

A drive sub 110 (alternatively termed a drive chuck) is positioned at the cutting end of the assembly 100 and in particular to surround bit shaft 106. Drive sub 110 comprises an axially forward end face 110*a* positioned towards bit head 107 and an axially rearward end face 110*b* accommodated within an axially forward region of casing 101. The sleeve-like drive sub 110 is mated in contact with the bit shaft 106 via a plurality of inter-engaging splines that extend both axially and radially at a radially outward facing surface of bit shaft and a radially inward facing surface of the drive sub 110. With assembly 100 coupled at an axially forward end of the drill string (not shown) rotational drive to the bit head 107 is transmitted through casing 101 and drive sub 110 to drill bit 105.

Drill bit 105 is releasably retained within hammer assembly 100 by a drill bit retaining assembly indicated generally by reference 108. Assembly 108 comprises a retainer ring 126 mounted to surround an axially rearward region of drill bit shaft 106; a locating collar 125 positioned axially intermediate retainer ring 126 and piston 103 with the drive sub 110 representing a third component of the retaining assembly 108. Assembly 108 is configured to retain drill bit 105 within casing 101 when the drill head 107 is not forced axially against the borehole bottom for example when the hammer 100 is lowered and raised within the borehole and when the drilling apparatus is operating in a fluid flushing mode between hammering operations. In particular, retainer ring 126 projects radially between casing 101 (towards forward end 101*b*) so as to be capable of radially overlapping a radially outward projecting shoulder 124 that represents an axially endmost region of drill bit shaft 106. That is, when bit head 107 is not forced axially against the borehole, drill bit 105 is capable of sliding axially downward under gravity and is retained (i.e., prevented from falling out of the hammer 100) by mating abutment contact between retainer ring 126 and shoulder 124. Locating collar 125 provides a means of holding retainer ring 126 in position at an axially forward location against the rearward end face 110*b* of drive sub 110.

The specific embodiment of FIG. 1 is further described and illustrated with reference to FIGS. 3 to 4. The second to fourth embodiments are described with reference to FIGS. 5 to 7; 8 to 11 and 12 to 14, respectively. For convenience, the majority of the features and components of the four embodiments are common with all four embodiments comprising a locating collar, a retainer ring and a drive sub with selected components configured to establish and maintain a flow pathway of a lubricant containing flushing fluid that passes over a radially outward facing surface of the retainer ring and into contact with a radially inward facing surface of the drive sub. Selected components of the retaining assembly are accordingly configured with indents in the forms of slots and/or grooves that define fluid flow pathway sections for the specific directing of the fluid flow over the radially outward facing surface of the retainer ring. Such a configuration is advantageous to provide a retainer ring 126 having a radially inner region and in particular a surface 143 that is optimised via a maximised surface area for abutment contact with the drill bit annular shoulder 124. Accordingly, the present retainer assembly 108 provides a reliable and secure retention of the drill bit 105 within the hammer assembly 100.

Figure 2:
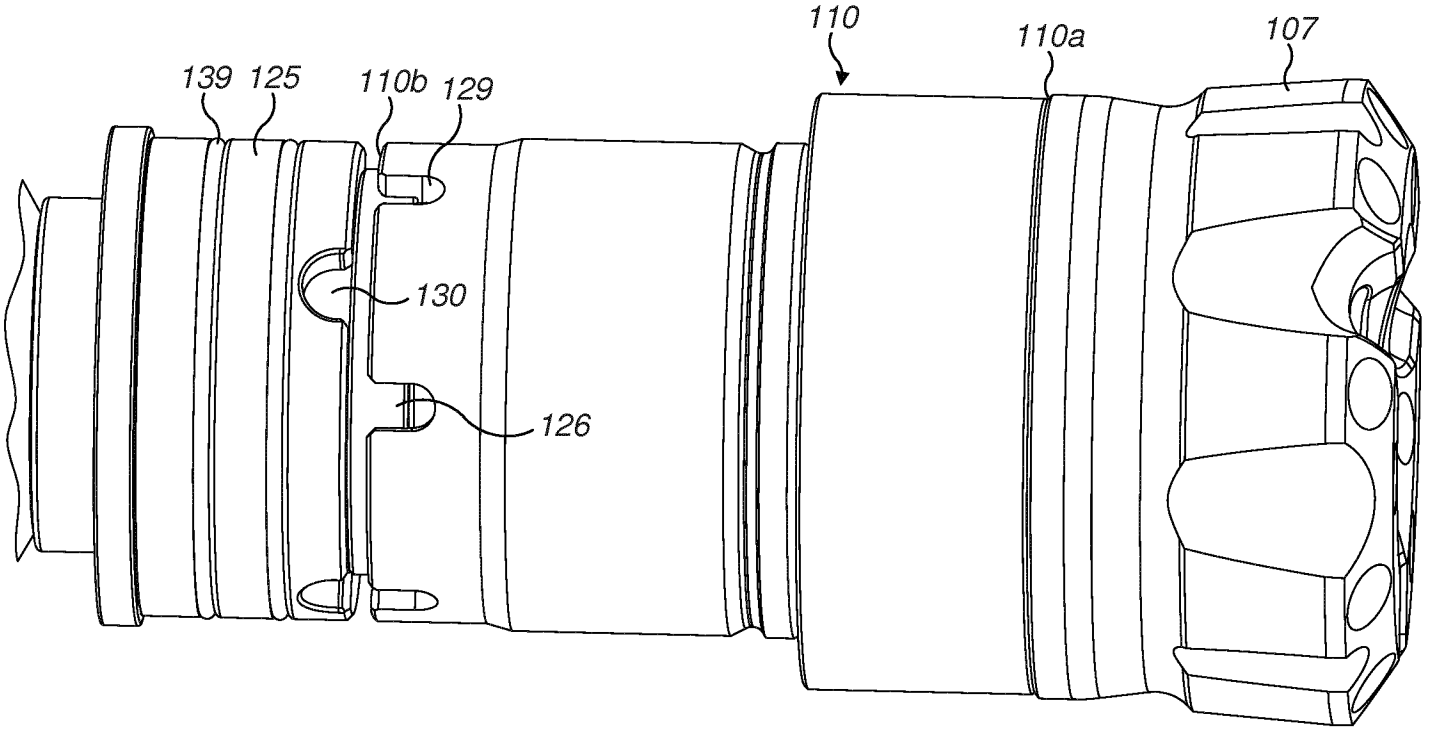
FIG. 2 is an external perspective view of a forward end of the hammer drill assembly of FIG. 1 detailing a drill bit retaining assembly according to the specific implementation of the present invention.
Figure 3:
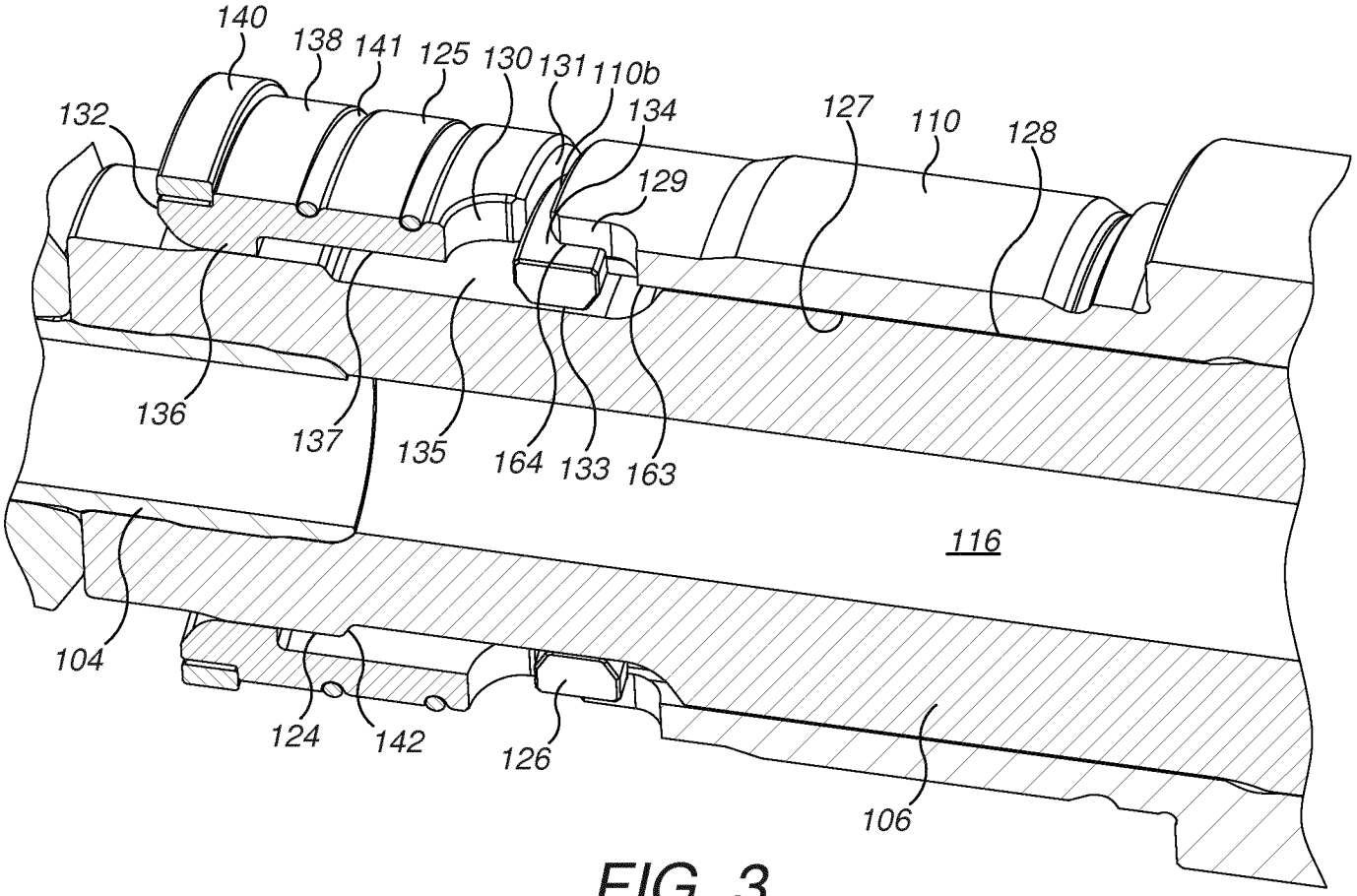
FIG. 3 is a cross sectional perspective view of the drill bit retaining assembly of FIG. 2.
Figure 4:
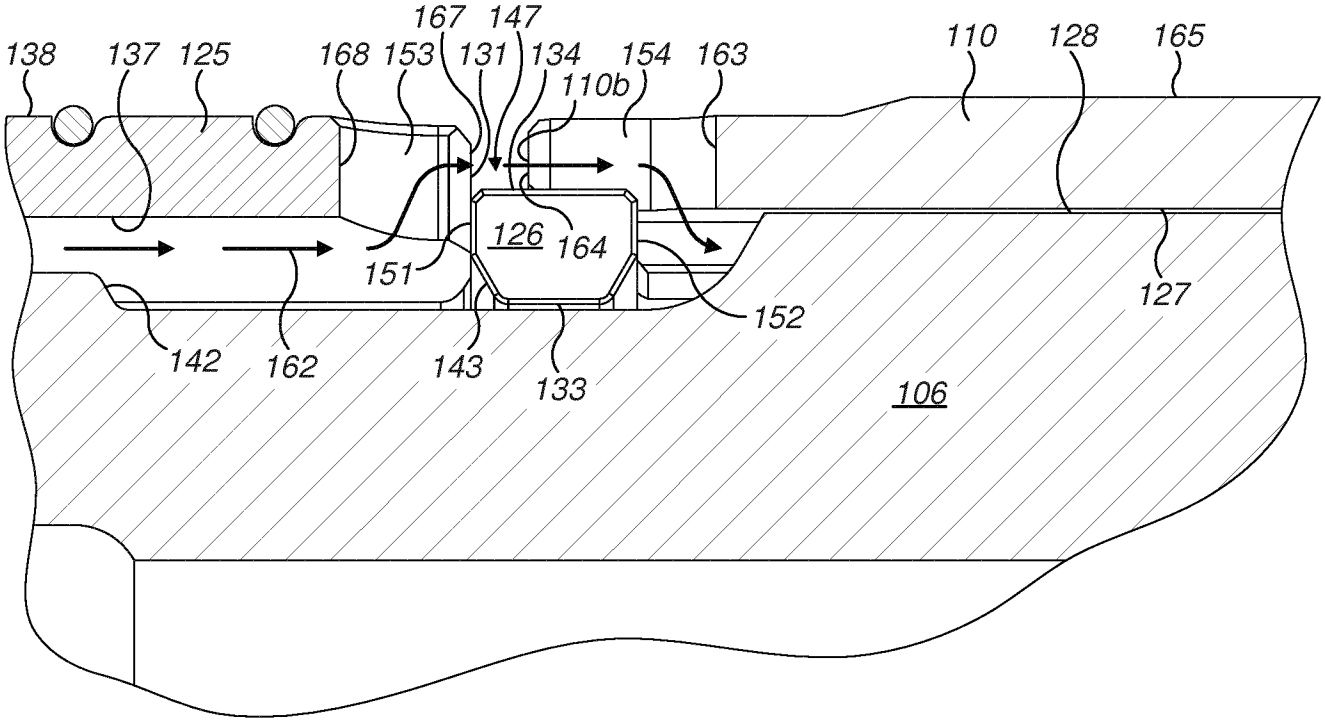
FIG. 4 is a further cross sectional perspective view of parts of the drill bit retaining assembly of FIG. 3.

Referring to FIGS. 2 to 4, locating collar 125 comprises an axially rearward annular end face 132 (facing towards piston 103) and an axially forward annular end face 131 positioned in contact with retainer ring 126. A radially inward facing surface 137 is positioned opposed to the axially rearward region of drill bit shaft 106. In particular, locating collar 125 is positioned to at least partially surround shaft shoulder 124, with shoulder 124 being slidable axially within collar 125. A radially outward facing surface 138 of collar 125 comprises two grooves 141 extending in the circumferential direction around collar 125 to house respective o-rings 139 to provide appropriate frictional contact against casing 101 and retain collar 125 in position during drill bit changes. An annular gasket 140 is also mounted at collar outward facing surface 138 and is locatable within a groove (not shown) recessed within casing 101 so as to retain collar 125 axially within the hammer assembly 100. Collar 125 is positioned within casing 101 to provide guiding and sealing against the rearward end of bit 105 via mating contact between the radially outward facing surface of bit shoulder 124 and raised ('ridge') regions of a radially inward facing surface 137 of collar 125. In particular, collar 125 comprises a set of axially extending grooves recessed into surface 137 to define fluid flow passageways between the raised regions. A set of slots 130 project into the body of collar 125 from forward end face 131 such that end face 131 is at least partially castellated. Slots 130 are distributed in a circumferential direction around collar 125 and extend over approximately over one quarter of an axial length of collar 125 between end faces 131, 132. Each of the slots 130 extends the full radial thickness of collar 125 between the inward and outward facing surfaces 137, 138 and are aligned in the circumferential direction with a respective groove at collar surface 137. With collar 125 mounted in position axially against retainer ring 126, slots 130 define openings 153 through the collar wall to allow the radially outward passage of fluid from a radially internal region 135 (positioned radially between bit shaft 106 and collar 125) to a radially external region positioned radially outward over retainer ring 126.

Retainer ring 126 is formed as a split-ring in which two circumferential half segments are positioned end-to-end to define a complete annular ring having two pairs of connected ends 148. Accordingly, ring 126 may be readily broken and reassembled about bit shaft 106. Ring 126 comprises a radially inward facing surface 133, a radially outward facing surface 134, an axially rearward face 151 and an axially forward face 152. Rearward face 151 at a radially inner region defines an axially rearward facing annular abutment surface 143 that is co-aligned with a corresponding and complementary annular abutment surface 142, being an axially forward facing surface of bit shoulder 124. Ring 126 and in particular inward facing surface 133 is mounted in close fitting contact with the outward facing surface 128 of bit shaft 106 at region 135 axially forward of bit shoulder 124. Inward facing surface 133 is slightly separated from bit shaft surface 128 so as to allow bit 105 to slide axially relative to retainer ring 126 until contact is made between the respective abutment surfaces 143, 142. Ring 126 is maintained in position axially by abutment contact between ring rearward face 151 and collar forward face 131. The axial and radial position of ring 126 is further established and maintained by abutment contact with the axial rearward region of drive sub 110. In particular, drive sub 110 at the region towards rearward annular end face 110*b* is dimensioned to sit radially over ring 126 with a part of drive sub inward facing surface 127 in contact with a part of the ring outward facing surface 134. Accordingly, drive sub 110 axially overlaps onto ring 126 so as to maintain the ring half-segments in the adjoined annular configuration as shown in FIGS. 1 to 4.

Being similar to locating collar 125, drive sub 110 also comprises a set of slots 129 projecting axially inward into the body of drive sub 110 from rearward annular end face 110*b*. Each slot 129 extends the full radial thickness of drive sub 110 between radially inward facing surface 127 and outward facing surface 165. Each slot 129 defines a corresponding opening 154 to allow the passage of a fluid to flow from an axially rearward and external region around ring 126 and into contact with the drive sub inward facing surface 127. An annular shoulder 168 is provided at the axially rearward region of drive sub 110 at inward facing surface 127 so as to mate against retainer ring 126. Shoulder 168 when abutted against retainer ring 126 secures axially the relative positions of retainer ring 126 and drive sub 110. According to the specific implementation, a channel 147 (being a small annular gap) is created and defined between the opposed annular end faces 131 and 110*b* (of collar 125 and drive sub 110 respectively) in addition to ring outward facing surface 134. Each drive sub slot 129 comprises an axially forward end 163 and an axially rearward end 164, with end 164 being co-aligned with annular end face 110*b*. With drive sub 110 mated axially and radially against an axially forward portion of retainer ring 126, an axial length of each slot 129 extends axially forward beyond retainer ring 126 such that an axially forward part of each opening 154 is positioned axially forward of retainer ring 126 to allow the flow of the flushing fluid radially inward and under drive sub 110 at the axially forward position of retainer ring 126. Similarly, each slot 130 extending within the axially forward region of collar 125 comprises a rearward end 166 and a forward end 167, with forward end 167 being co-aligned axially with collar end face 131. The axial length of each collar slot 130 corresponds approximately to the axial length of each drive sub slot 129. However, the full axial length of each collar slot 130 is positioned axially rearward of retainer ring 126 such that the size of the respective openings 153 within collar 125 are greater than the size of the 'unobstructed' drive sub openings 154 (positioned axially forward of retainer ring 126).

The configuration of collar 125, retainer ring 126 and drive sub 110 functions to establish a desired fluid flow pathway indicated generally by reference 162 that extends axially in contact with collar 125 then retainer ring 126 and finally drive sub 110. In particular, when bit 105 is axially extended i.e., during flushing mode (e.g., when bit 105 falls downward under gravity between downward drilling intervals), bit shoulder 124 slides forward from an axial rearward annular end region 136 of collar 125 to open the fluid channels defined by the grooves at the collar inward facing surface 137. Accordingly, an open flow pathway is created from the axially forward chamber region 111*b* (positioned axially forward of piston 103) and region 135 (located radially between bit shaft 106 and collar 125 and axially behind retainer ring 126). As such, the lubricant containing flushing fluid is introduced into region 135 and is then directed radially outward through openings 153 and into the annular channel 147 in contact with the ring outward facing surface 134. The fluid flow continues axially forward into drive sub openings 154 where it is redirected radially inward into the region radially between drive sub 110 and bit shaft 106 and hence in contact with the opposed inward and outward facing surfaces 127, 128 of the drive sub 110 and bit shaft 106, respectively. Accordingly, the fluid flow pathway 162 extending radially outward around ring 126 obviates any requirement to configure the radially inner region of ring 126 to accommodate the fluid flow as is conventional with existing arrangements. Accordingly, the available contact area of the ring abutment surface 143 is maximised and is defined by a complete annular surface for mating contact against the annular abutment surface 142 of bit shoulder 124. As such, the present configuration enables the supply of lubricant containing fluid into contact with the splines of the drive sub 110 and bit shaft 106 via the desired flow pathway 162 extending radially over retainer ring 126.

Figure 5:
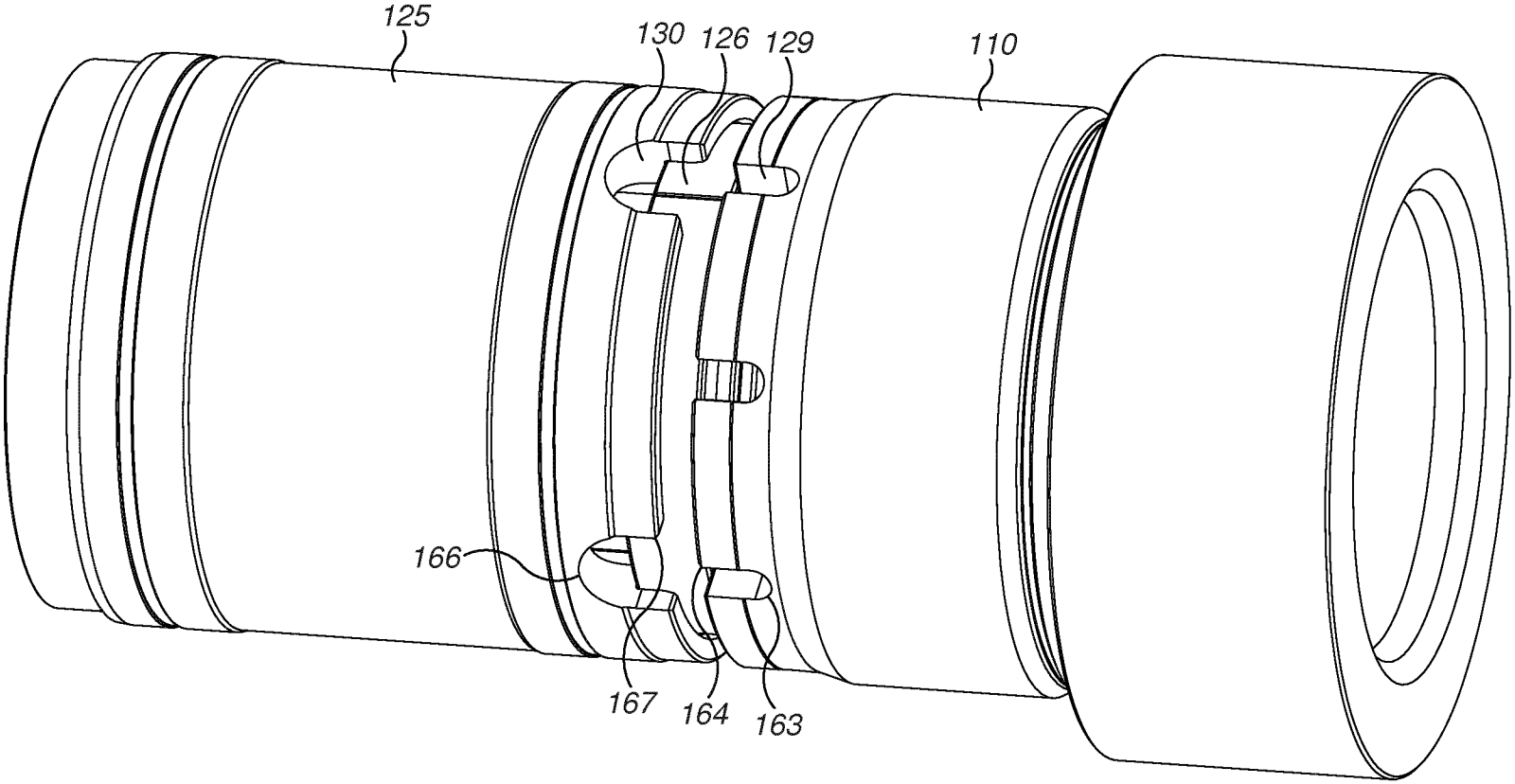
FIG. 5 is an external perspective view of the drill bit retaining assembly according to a second embodiment of the subject invention.
Figure 6:
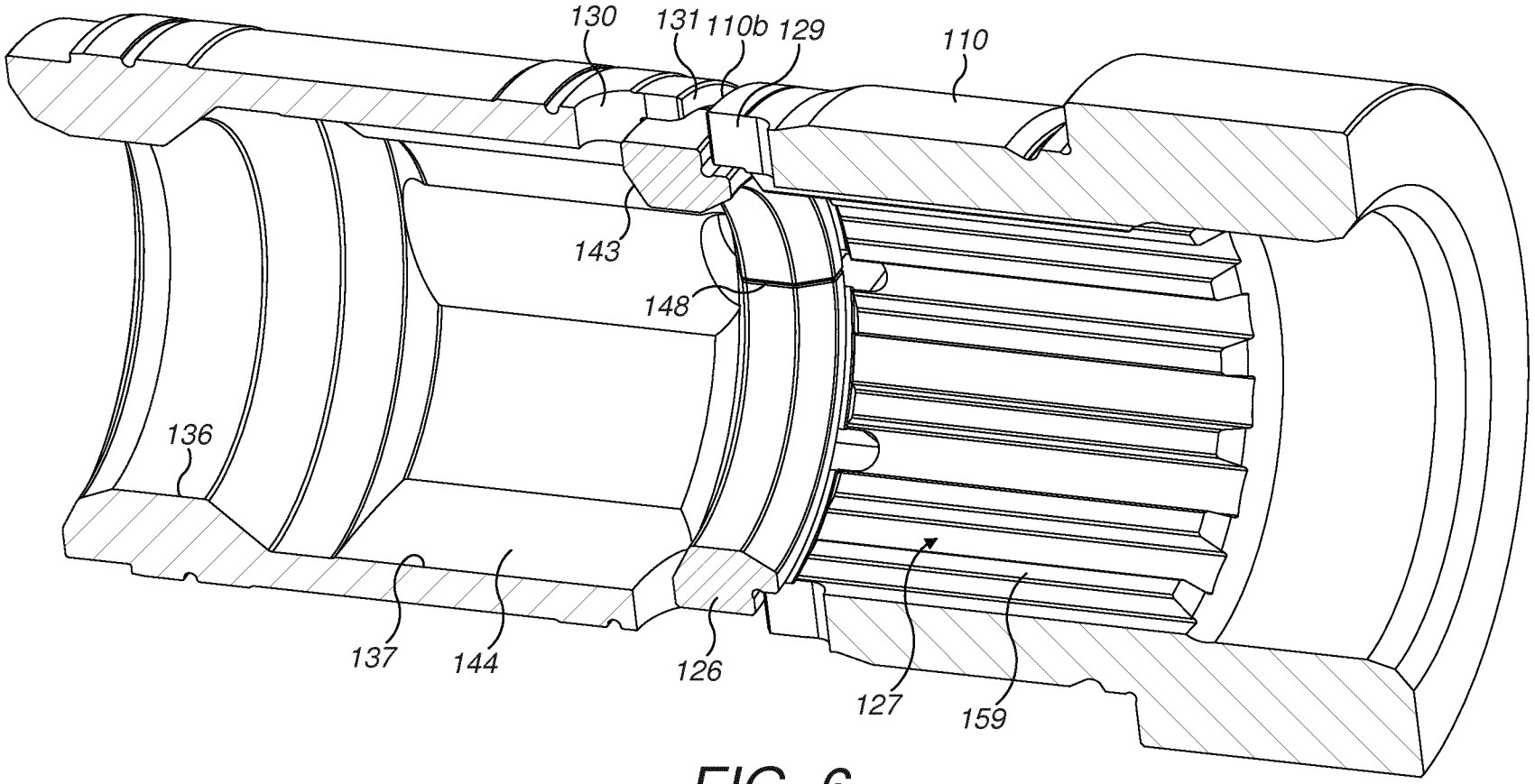
FIG. 6 is a cross sectional perspective view of the bit retaining assembly of FIG. 5.
Figure 7:
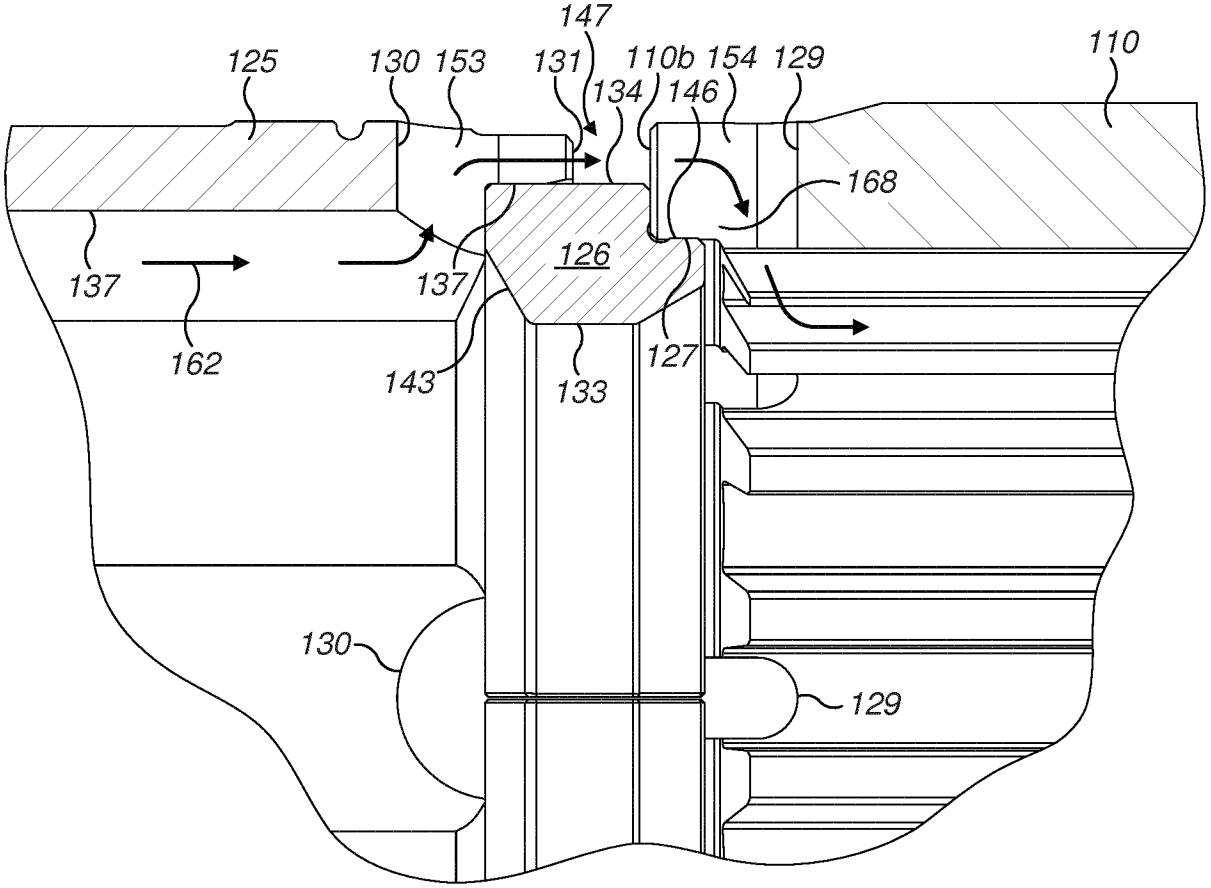
FIG. 7 is a further cross sectional perspective view of the retaining assembly of FIG. 6.
Figure 8:
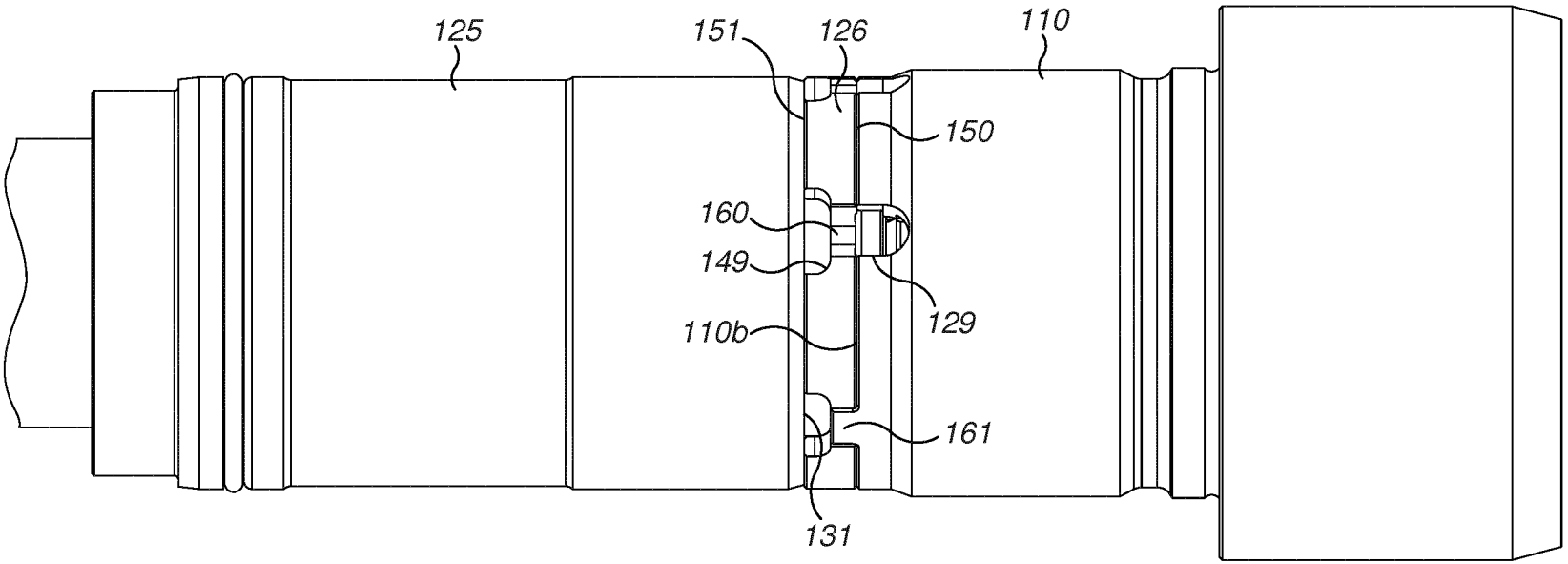
FIG. 8 is an external perspective view of a drill bit retaining assembly according to a third embodiment of the present invention.

The further embodiments of FIGS. 5 to 14 share corresponding components and features as described with reference to the first embodiment of FIGS. 2 to 4. Such components and configuration is accordingly not reiterated. Referring to FIGS. 5 to 7 a second embodiment of the subject invention corresponds to the first embodiment of FIGS. 2 to 4 save for variation of the configuration of the inward facing surface 137 of collar 125 and an axially forward region of retainer ring 126.

According to the embodiment of FIGS. 5 to 7, split ring 126 comprises a shoulder 146 extending from axially forward annular face 152. The radially outward facing ring shoulder 146 is configured to mate with the complementary radially inward facing annular drive sub shoulder 168. Accordingly, ring 126 via the shoulders 146, 168 is capable of being interconnected to sit at least partially under the axially rearward end of drive sub 110 to be maintained in the axial and radial position within hammer 100. According to the second embodiment, collar 125 is also configured slightly differently to the embodiment of FIGS. 2 to 4 by comprising axially extending grooves (or channels) 144 recessed into the radially inward facing surface 137. Grooves 144 are spaced apart in the circumferential direction around the collar 125 and extend axially from collar rearward end region 136 to collar forward end face 131. Grooves 144 are configured to facilitate axial forward delivery of the fluid along flow pathway 162 and through the respective openings 153, 154 via the ring external side (surface 134). FIGS. 6 and 7 illustrate the retainer assembly 108 with the drill bit 105 removed so as to detail the axially extending splines 159 projecting radially inward from the drive sub inward facing surface 127. Splines 159, whilst not illustrated specifically, are common to all the four embodiments described herein and comprise the same radial and axial configuration being complementary with the splines (not shown) projecting radially outward from the drill bit shaft 106.

Figure 9:
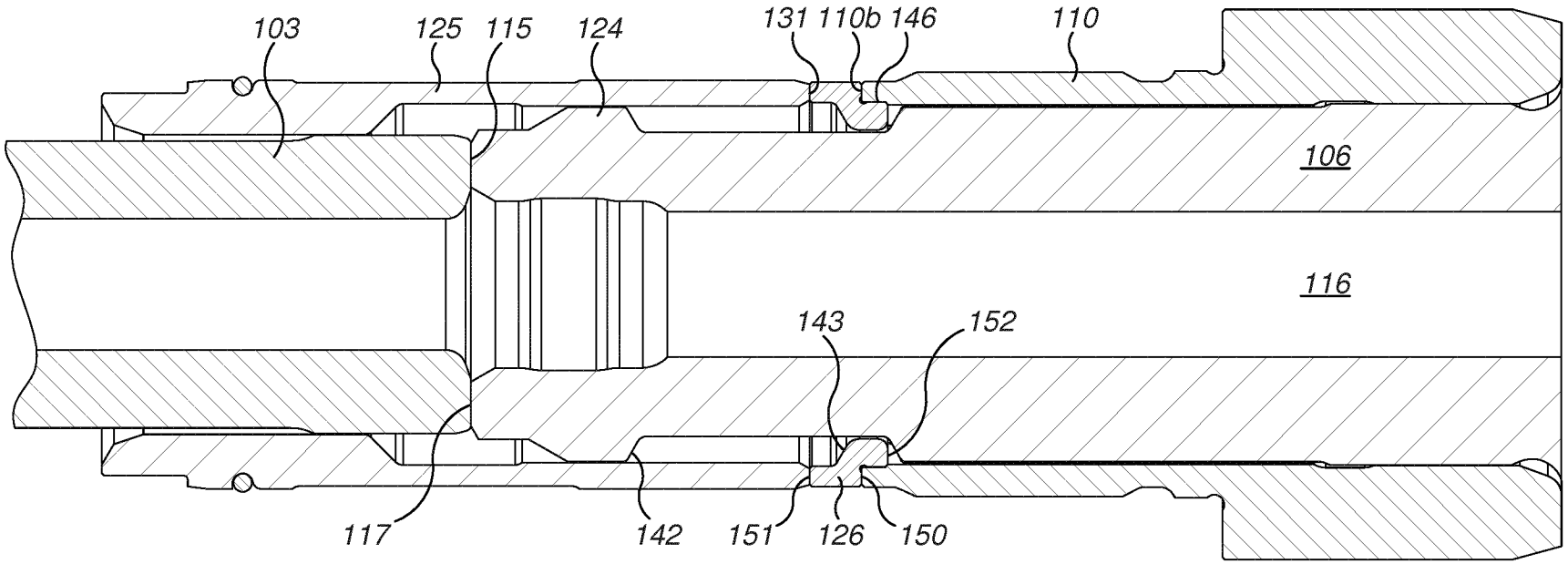
FIG. 9 is a cross sectional perspective view of the bit retaining assembly of FIG. 8.
Figure 10:
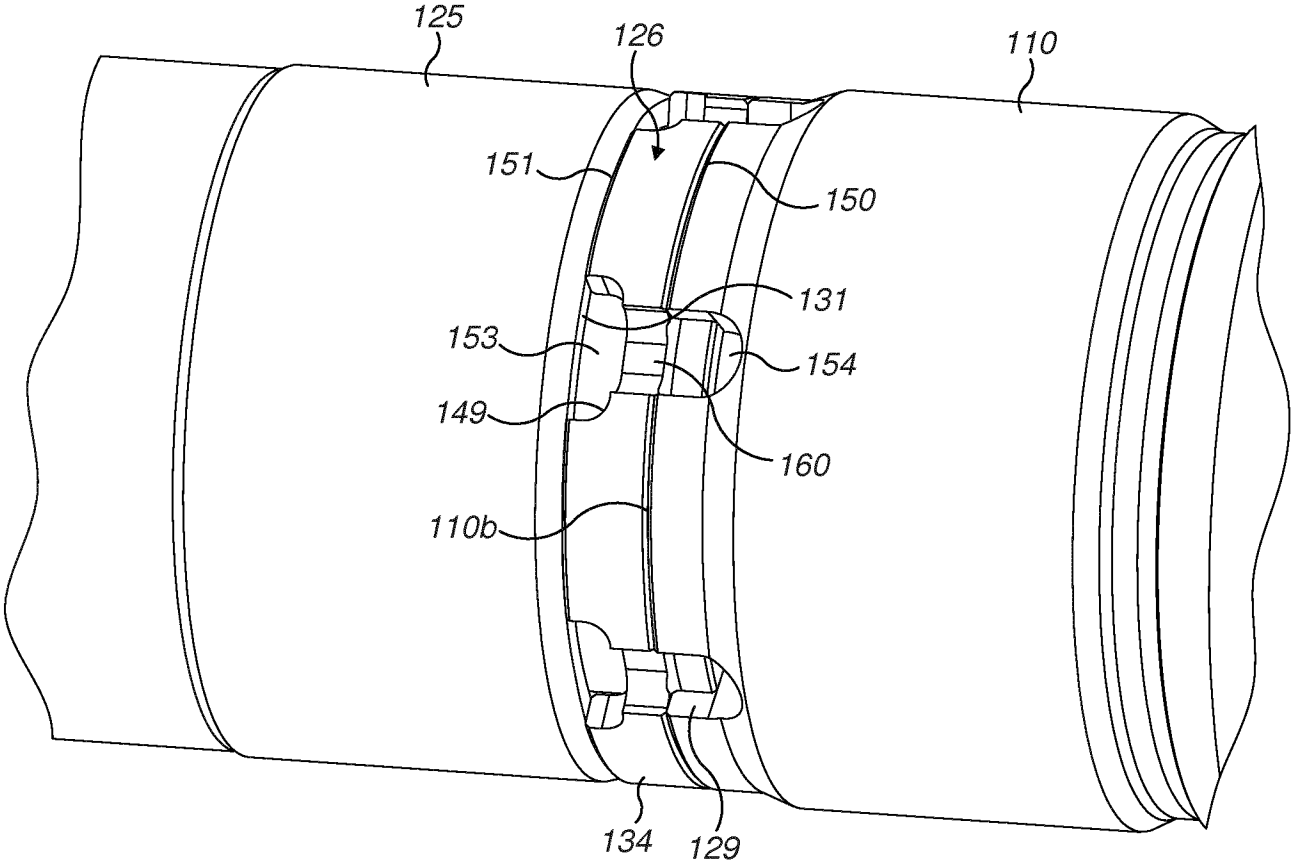
FIG. 10 is a further perspective view of the drill bit retaining assembly of FIG. 9.
Figure 11:
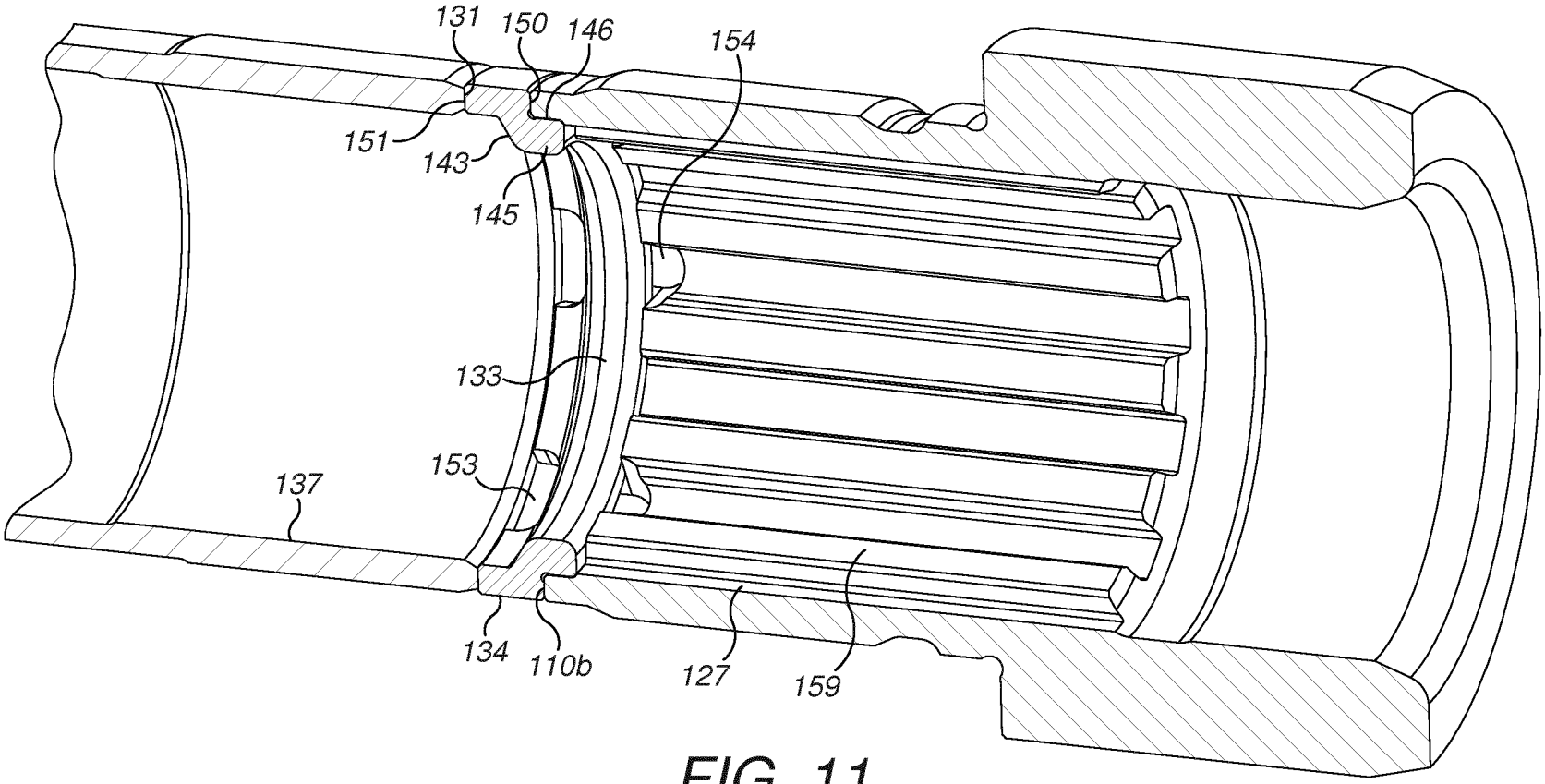
FIG. 11 is a further cross sectional perspective view of the drill bit retaining assembly of FIG. 10.

The third embodiment is described with reference to FIGS. 8 to 11 which, like embodiments 1 and 2, directs and maintains fluid flow pathway 162 in contact with the inward facing collar surface 137 through openings 153 (defined by slots 130) to then pass at the radially external side of retainer ring 126 and through corresponding openings 154 (defined by slots 129) within the axially rearward end of drive sub 110. As illustrated in FIG. 9 the subject invention is compatible for use with different arrangements of piston 103 and drill bit 105. For example, drill bit 105 need not comprise a foot valve at its axially rearward end to mate with the reciprocating piston 103. Locating collar 125 comprises a smooth inward facing surface having a uniform internal diameter consistent with the first embodiment. However, the annular end face 131 is devoid of slots 130 and is generally circular. End face 131 is configured to abut rearward face 151 of retainer ring 126. Ring 126, like the second embodiment, comprises an axially forward stepped section 146 such that an axially forwardmost radially inner part 145 is located radially inside and axially overlapping with the rearward axial end of drive sub 110. The ring stepped section 146 provides a radially extending annular abutment face 150 to abut the drive sub rearward end face 110*b*. Ring 126 as with all embodiments described herein is a split ring and is maintained in axial and radial position by overlapping contact by the drive sub 110.

To provide the openings 153 for the through-flow of the flushing fluid, retainer ring 126 comprises slots 149 extending the full radial thickness of ring 126 and axially into the ring body from rearward facing end face 151. Slots 149 extend to an approximate mid-axial length position between end face 151 and abutment face 150. Each slot 149 is terminated axially by a respective groove 160 recessed into the outward facing ring surface 134. Common to all embodiments described herein, drive sub 110 comprises slots 129 extending axially from rearward end face 110*b*. A width in a circumferential direction of each ring groove 160 is equal to a corresponding width in a circumferential direction of each drive sub slot 129. Slots 149 and 129, as before, define respective openings 153, 154 between the radially internal and external regions of the retainer assembly 108. According to the third embodiment, retainer ring outward surface 134 is generally co-aligned with the collar outward facing surface 138 and the corresponding drive sub outward facing surface 165. As such, there is no annular channel 147 through which the fluid may flow and be distributed when passing over the retainer ring outward surface 134. This necessitates alignment (in the circumferential direction) of the retainer ring slots 149 (and grooves 160) with the drive sub slots 129 in order to establish the desired axially forward fluid flow pathway 162. Accordingly, drive sub 110 comprises an axially extending finger 161 projecting axially rearward from end face 110*b*. Finger 161 is dimensioned to sit within one of the retainer ring grooves 160 and prevents independent rotation of the drive sub 110 and the retainer ring 126.

Figure 12:
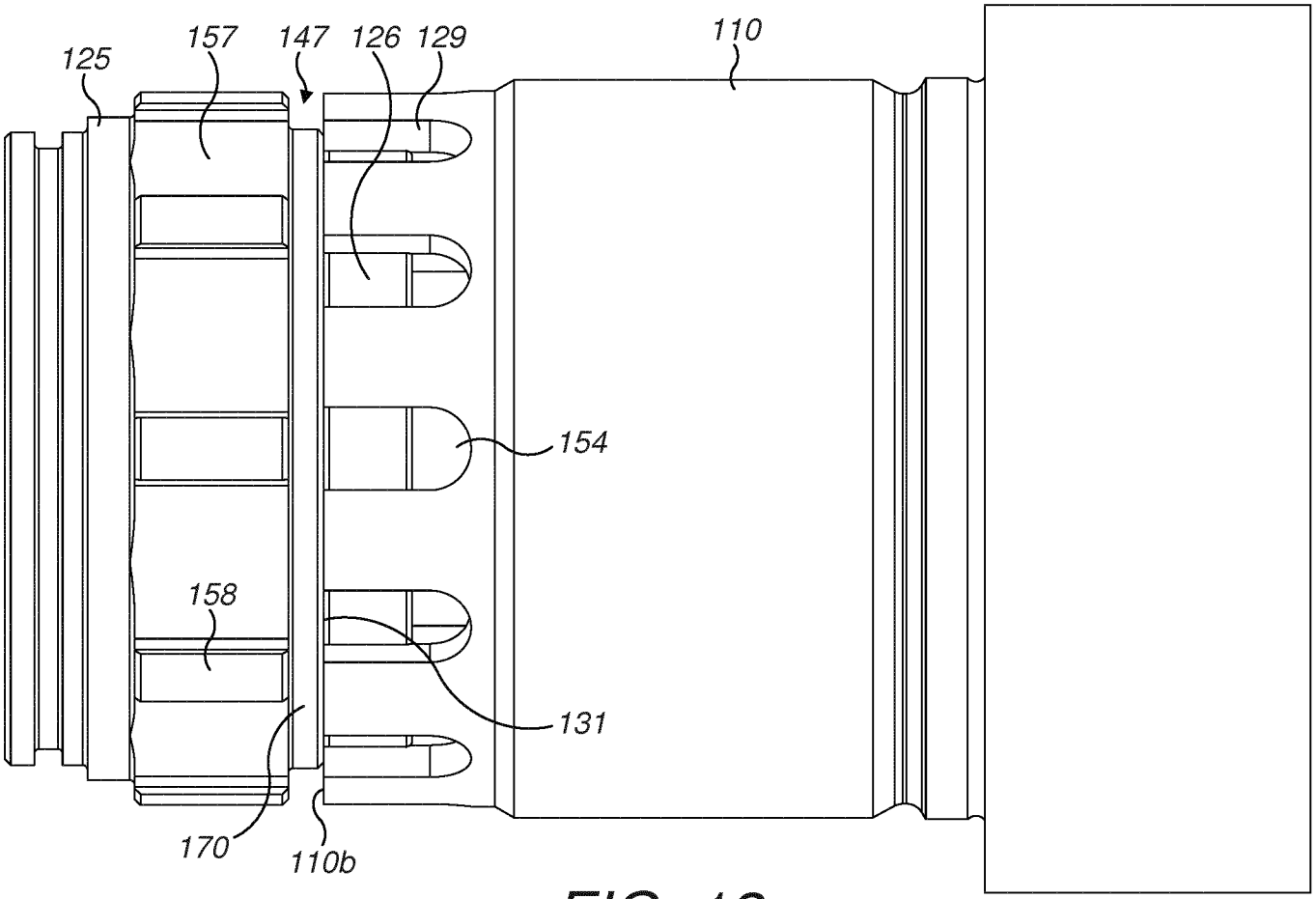
FIG. 12 is an external perspective view of a drill bit retaining assembly according to a fourth embodiment of the present invention.
Figure 13:
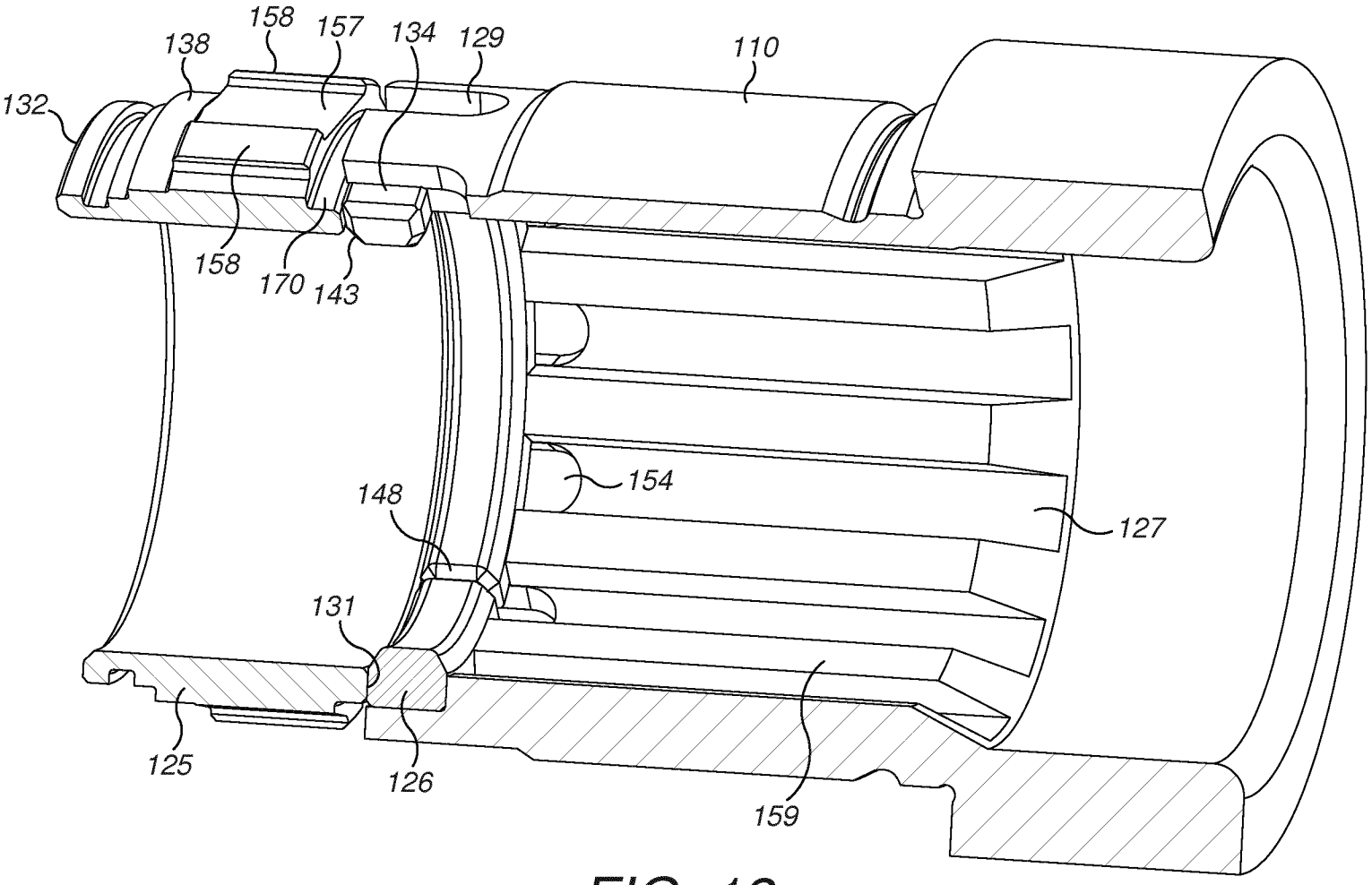
FIG. 13 is a cross sectional perspective view of the drill bit retaining assembly of FIG. 12.
Figure 14:
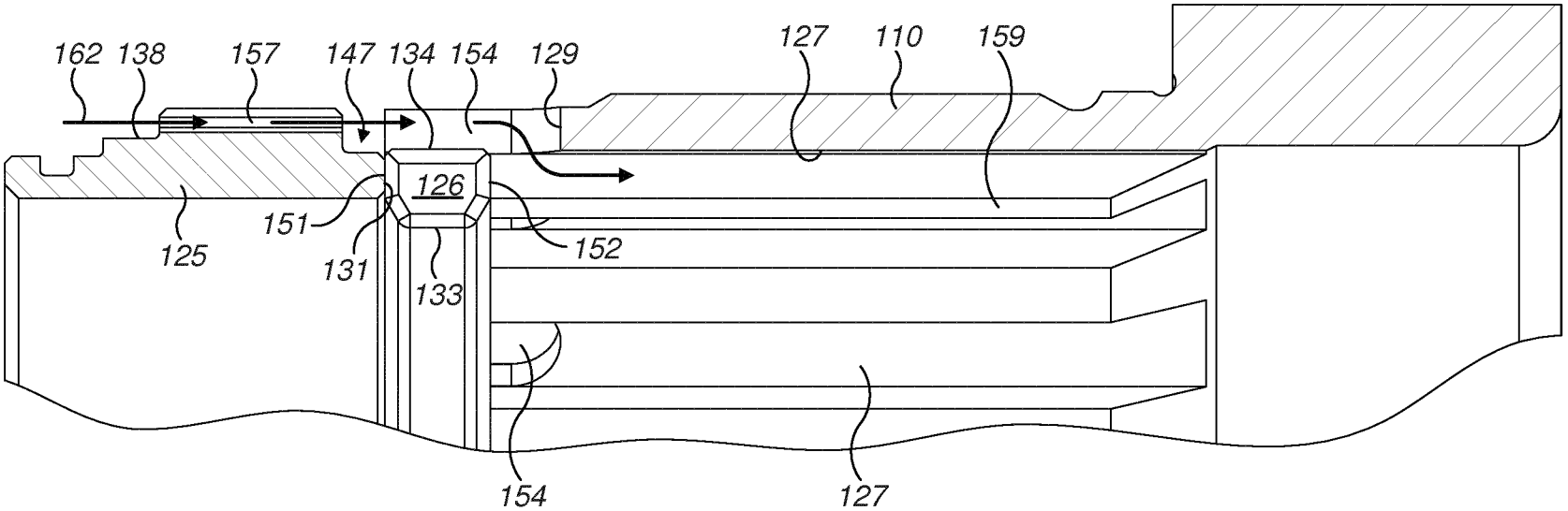
FIG. 14 is a further cross sectional perspective view of the drill bit retaining assembly of FIG. 13.

The fourth embodiment is described referring to FIGS. 12 to 14 and comprises a drive sub 110 and a retainer ring 126 corresponding and consistent with the first embodiment of FIGS. 2 to 4. However, the assembly is configured differently so as to establish the fluid flow pathway 162 over the radially outward facing collar surface 138 and not under the inward facing collar surface 137 as described previously. To facilitate the fluid flow pathway 162 as illustrated in FIG. 14 onto the ring outward facing surface 134 and into the drive sub openings 154, collar 125 comprises a set of axially extending grooves 157 spaced apart in a circumferential direction around collar 125. Each groove 157 may be considered to be separated (in the circumferential direction) and defined by axially extending ridges 158 such that collar 125 comprises a castellated cross sectional profile. Grooves 157 and ridges 158 terminate a short axial distance before collar annular end face 131. Accordingly, collar 125 comprises an annular channel 170 at outward facing surface 138 that extends immediately axially rearward from end face 131. As end face 131 is abutted against ring rearward face 151, the collar ridges 158 and grooves 157 are axially separated from drive sub end face 110*b* to establish the annular distribution flow channel 147. According to the fourth embodiment, retainer ring 126 is housed completely within the rearward end of drive sub 110 such that ring rearward end face 151 and drive sub end face 110*b* are co-aligned. The retainer ring outward surface 134 is accordingly exposed in the region of each drive sub slot 129 (as described previously) and each drive sub slot 129 extends axially beyond retainer ring 126 such that a part of openings 154 extend axially forward of retainer ring 126. According to the fourth embodiment, the fluid flow is directed externally over collar 125 via grooves 157 and the collar rearward end face 132. The fluid then enters annular channel 147 and continues axially forward into drive sub slots 129 over retainer ring outward surface 134. The fluid flow is then directed radially inward (at the axially forward region of openings 154) into contact with splines 159 so as to provide the desired flushing and lubrication.

The invention claimed is:

1. A down-the-hole hammer drill bit retaining assembly arranged to releasably retain a drill bit at a hammer arrangement, the retaining assembly comprising:

an annular drive sub having a rearward end and a radially inward facing surface provided with radially inward projecting splines arranged to mate with radially outward projecting splines of the drill bit;

a retainer ring mountable in contact with the rearward end of the drive sub, the retainer ring having a radially inward and outward facing surface and an axially rearward facing abutment face arranged to overlap radially with and abut a shoulder projecting radially outward from the drill bit; and at least one passageway defined by at least a part of the drive sub and/or the retainer ring, the at least one passageway having a rearward end in fluid communication with the outward facing surface of the retainer ring and a forward end in fluid communication with the inward facing surface of the drive sub to provide a fluid communication pathway for the delivery of a fluid over the outward facing surface of the retainer ring and to the splines of the drive sub, wherein the at least one passageway is a slot extending through a radial thickness of the drive sub between an outward facing surface and the inward facing surface at or towards the rearward end of the drive sub.

2. The assembly as claimed in claim 1, wherein the retainer ring and the drive sub are configured such that the drive sub is positionable to axially overlap and to radially encompass at least a part of the retainer ring.

3. The assembly as claimed in claim 2, wherein the at least one passageway extends axially along the drive sub beyond a region of the axial overlap of the drive sub and the retainer ring.

4. The assembly as claimed in claim 1, wherein in a circumferential direction around an annular length of the retainer ring, the retainer ring has a uniform internal diameter.

5. The assembly as claimed in claim 1, herein the drive sub includes an annular shoulder provided at or towards the rearward end of the drive sub and arranged to mate with the retainer ring.

6. The assembly as claimed in claim 5, wherein the retainer ring includes an annular shoulder arranged to mate with the annular shoulder of the drive sub.

7. The assembly as claimed in claim 1, wherein the drive sub is mountable in fluid tight sealing contact with the retainer ring such that the at least one passageway provides exclusively the fluid communication pathway from the outward facing surface of the retainer ring to the splines.

8. The assembly as claimed in claim 1, wherein in a circumferential direction around an annular length of the retainer ring, the retainer ring has a uniform external diameter.

9. The assembly as claimed in claim 1, wherein the retainer ring includes at least one indent at the outward facing surface to further define the fluid communication pathway at a region of the retainer ring.

10. The assembly as claimed in claim 9, wherein the indent of the retainer ring is a slot extending through a radial thickness of the retainer ring between the inward and outward facing surfaces and/or is a groove extending axially along at least part of the retainer ring to define a part of the fluid communication pathway to the outward facing surface of the retainer ring.

11. The assembly as claimed in claim 1, further comprising a locating collar having an inward facing surface mountable over an axially rearward part of the drill bit and having an axially forward end in contact with at least a part of the retainer ring.

12. The assembly as claimed in claim 11, wherein the locating collar includes at least one indent extending axially from the forward end to further define a part of the fluid communication pathway to the outward facing surface of the retainer ring.

13. The assembly as claimed in claim 12, wherein the indent is a slot extending radially through a thickness of the locating collar between a radially outward and inward facing surface and/or the indent is an axially extending groove formed in the outward facing surface of the locating collar.

14. A drilling apparatus for percussive rock drilling comprising:

a hammer arrangement mountable at one end of a drill string, the hammer arrangement including an axially movable piston;

a drill bit mounted at least partially within the hammer arrangement; and a retaining assembly as claimed in claim 1, arranged to releasably retain the drill bit at the hammer arrangement.

* * * * *